United States Patent [19]

Snell

[11] 3,990,837

[45] Nov. 9, 1976

[54] COMBUSTION EQUIPMENT FOR GAS TURBINE ENGINES

[75] Inventor: Leonard Stanley Snell, Bristol, England

[73] Assignee: Rolls-Royce (1971) Limited, Great Britain

[22] Filed: Dec. 1, 1975

[21] Appl. No.: 636,714

[30] Foreign Application Priority Data

Dec. 7, 1974 United Kingdom ..... 52996/74

[52] U.S. Cl. ..... 431/352; 60/39.65; 431/10

[51] Int. Cl.[2] ..... F23D 15/02

[58] Field of Search ..... 431/10, 352; 60/39.65, 60/39.66, 39.23

[56] References Cited

UNITED STATES PATENTS

| | | | |
|---|---|---|---|
| 3,364,969 | 1/1968 | Stephenson | 431/352 |
| 3,557,553 | 1/1971 | Schmitz | 60/39.65 |
| 3,745,766 | 7/1973 | Melconian | 60/39.65 X |
| 3,930,368 | 1/1976 | Anderson et al. | 60/39.23 |

*Primary Examiner*—Edward G. Favors
*Attorney, Agent, or Firm*—Stevens, Davis, Miller & Mosher

[57] ABSTRACT

The disclosure of this invention relates to a gas turbine engine combustion chamber including a flame tube having holes closed by a filling of a material of lower melting point than the flame tube material so that if in operation the temperature of the tube exceeds that of the filling the latter melt and cooling air can enter the tube through the holes.

8 Claims, 3 Drawing Figures

COMBUSTION EQUIPMENT FOR GAS TURBINE ENGINES

This invention relates to combustion equipment for gas turbine engines.

The combustion equipment of a gas turbine engine normally consists of a single annular combustion chamber or a series of substantially cylindrical chambers mounted in an annular arrangement. Inside the combustion chamber is located a cylindrical flame tube. The flame tube is supplied at its upstream end with air and fuel and consists of two parts: a primary combustion zone and a dilution zone. The temperature of the combustion gases released by the combustion zone is very high i.e. 1800° to 2000° centigrade which is far too hot for entry to a turbine, and thus cooling air is introduced progressively into the dilution zone of the flame tube to cool these gases. This air is known as dilution air. Cooling air is also fed to the inside walls of the flame tube to cool them since these also would not withstand such temperatures. The cooling air enters the flame tube through small holes or channels to cool the inside walls and the dilution air through larger holes to cool the combustion gases therein. As may be appreciated the sizes and arrangements of these holes is very critical since too little air will cause overheating of the flame tube and turbine or will cause local hot spots in the flame tube to form, and too much air will cool the flame and incomplete combustion will result.

It is an object of the present invention to provide combustion equipment for a gas turbine engine which will reduce the possibility of overheating of the flame tube or the formation of local hot spots therein.

According to this invention combustion equipment for a gas turbine engine comprises a wall defining a flame tube and made of a material having a given melting temperature, first holes in said wall for the entry of combustion and dilution air into the interior of the tube, second holes provided in said wall, a filling contained in said second holes and being made of a material having a melting temperature less than that of the wall material, whereby if in operation the temperature of the tube exceeds the melting temperature of the fillings the latter melt and cooling air can enter the tube through the second holes.

Thus the whole flame tube may be provided with a plurality of second holes which are filled with a material of a lower melting point than that of the flame tube, or selected areas which are more prone to excess heating may be provided with the second holes. Such areas may comprise portions of the primary zone or the dilution zone but preferably a plurality of holes is provided in the flame tube adjacent to dilution air holes whereby the effective area of the dilution holes is increased when the temperature of the flame tube surrounding the dilution holes exceeds a predetermined value.

The material used to fill the further holes may comprise a brazing material and may for example have a melting point of 800° centigrade.

An embodiment of the invention will now be described by way of example only in which.

Figure 1:
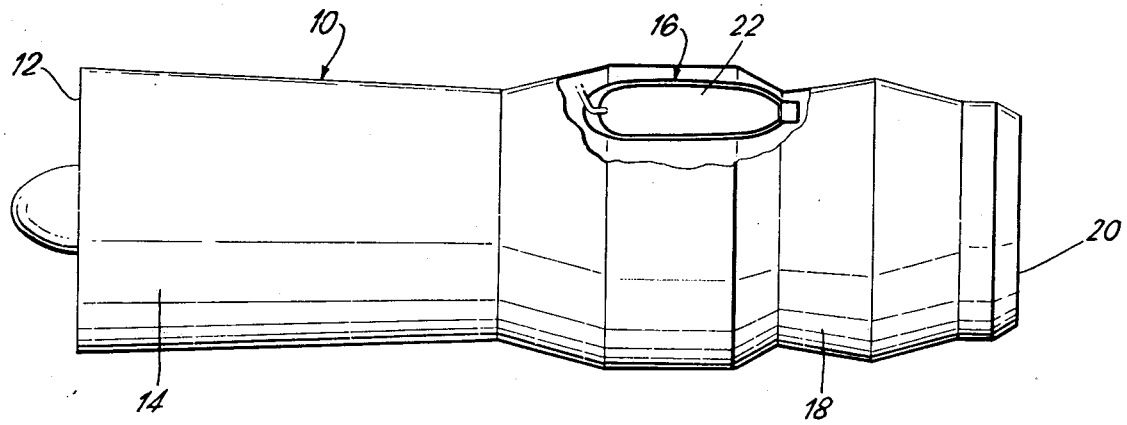
FIG. 1 shows a gas turbine engine having combustion equipment constructed in accordance with the invention and FIG. 2 is a cutaway enlarged view of the combustion equipment of the engine shown in FIG. 1.
Figure 2:
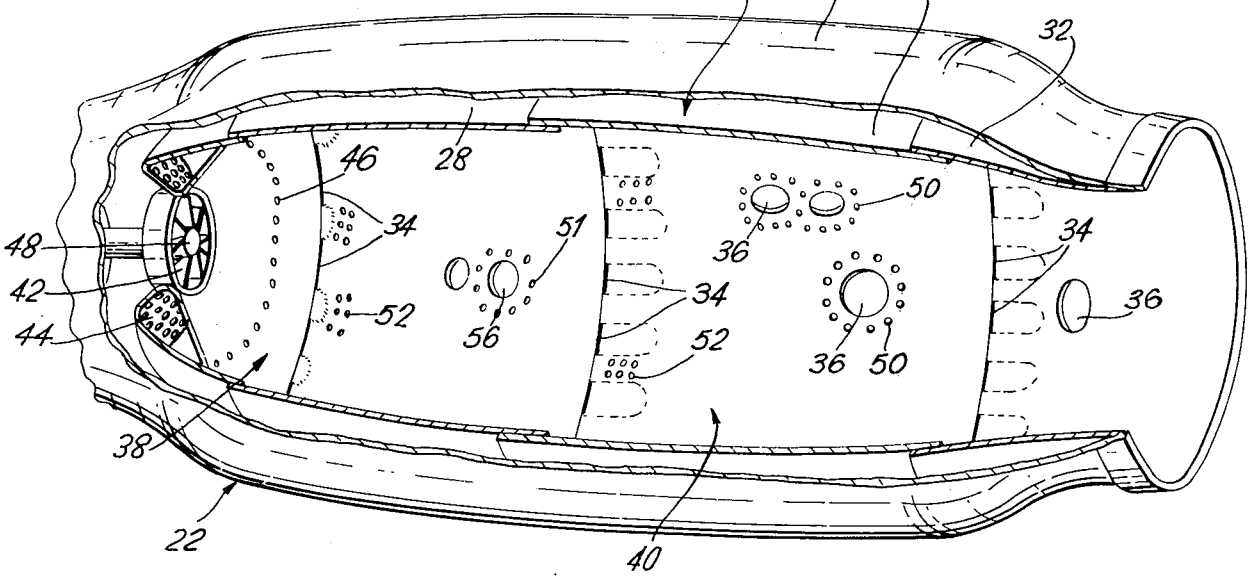

The gas turbine engine 10 comprises an intake 12, an axial flow compressor 14, combustion equipment 16, an axial flow turbine 18 adapted to drive the compressor 14 and an exhaust nozzle 20, arranged in flow series. The combustion equipment comprises a plurality of substantially cylindrical combustion chambers 22, one of which is shown in FIG. 1, these chambers being arranged in an annular array. A cutaway view of a combustion chamber is shown in detail in FIG. 2.

The combustion chamber 22 comprises an outer air casing 24 and a substantially cylindrical flame tube 26 located within the combustion chamber 22 and spaced from the air casing 24. The flame tube 26 is supported at each end by the air casing 24. The flame tube is defined by walls having the form of overlapping cylinders 28, 30, 32 with slots 34 (whose function will be described later) extending through the overlapping portions. The cylinders 30, 32 are provided with dilution air holes 36.

In operation the upstream end of the combustion chamber is supplied with air from the engine compressor, some of which passes into the space between the flame tube 26 and the air casing 24, and the remainder enters the flame tube through swirl vane 42 and a perforated flare 44, this latter air passing into the upstream end or primary zone 38 of the flame tube 26 through air holes 46. Further air enters the upstream end of the flame tube through primary air holes 56. The air from the swirl vanes 44, the holes 46 and the primary air holes 56 interacts and creates a region of low velocity recirculation in the upstream end of the flame tube 38, known as the primary zone, which hastens the burning of freshly injected fuel droplets from a fuel injector 48.

The temperature of the combustion gases released by the primary zone can be 1800° to 2000° centrigrade which is far-too hot for entry to the turbine and dilution air is therefore allowed to enter the flame tube progressively downstream of the primary zone in what is known as the dilution zone 40, through the dilution holes 36. The dilution air lowers the gas temperature to a value which can be withstood by the turbine. Air also enters the flame tube through the slots 34 and this air forms a cooling film of air on the inside walls of the flame tube to prevent the walls from overheating. It will be appreciated that the arrangements and sizes of the slots 34, the primary air holes 56 and the dilution holes 36 are very important since if too much air enters the flame tube the combustion gases will be overcooled and incomplete combustion will result, and if too little air enters, the combustion chamber and/or the turbine could overheat or local hot spots in the combustion chamber could result.

Figure 3:
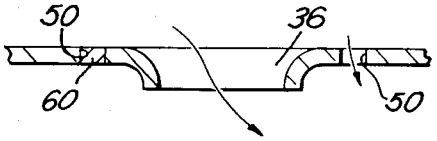
FIG. 3 is an enlarged detail of FIG. 2.

A plurality of smaller further holes 50, 51, 52 are therefore provided, the further holes 50 surrounding dilution air holes 36, the further holes 51 surrounding the primary air holes 56, and the further holes 52 being located adjacent the slots 34. These further holes are initially completely filled (FIG. 3) with a filling 60 made of a material having a lower melting point than the material of the flame tube, and is conveniently a braze material with a melting point of 800°–850° centigrade. Thus if the temperature of a portion of the flame tube in which these further holes are provided exceeds, say, 800° C, the braze material melts, and air enters through the further holes to further cool the combustion gases in the flame tube. It will be seen that if the material in the further holes 50, 51 melts then the effective areas of the dilution holes 36 and the primary air holes 56 are increased.

Any parts of the flame tube which are prone to overheating can be provided with the further holes. Thus the further holes 52 are located between the slots 34 which parts of the flame tube may reach a higher temperature than the parts of the flame tube immediately adjacent to the slots 34.

Whilst a gas turbine engine has been described having combustion equipment consisting of a plurality of substantially cylindrical flame tube, the invention is equally applicable to annular flame tubes.

Examples of materials to be used for the flame tubes are a 75/25 nickel/chromium wrought alloy, and a wrought super alloy having 20% chromium, 20% cobalt, 6% molybdenum, 2% titanium and 0.5 aluminium, remainder nickel. Such alloys having melting temperatures in region of 1200° – 1500° C.

Examples of materials to be used for the filling are nickel-based brazing alloys such as an alloy having 10 – 12% phosporus, remainder nickel (melting temperature 875° C) or an alloy having 9 – 11% phosporus, 11 – 15% chromium, remainder nickel (melting temperature 890° C). For lower temperatures silver-based brazing alloys may be used such as an alloy having 5% palladium, 26% copper, remainder silver (melting temperature 800° – 810° C), and different melting temperature between 800° and 900° C can be obtained by choosing different percentages of palladium, the temperature increasing with an increase in palladium.

The fillings may be applied by melting the filling material into the holes 50, 51, 52 and after solidification removing surplus filling materials from the surface of the tube.

The holes 50, 51, 52 may be provided locally as shown or they may be provided in the form of a perforation over at least a part of the wall of the flame tube or of a section of the flame tube. Thus, for example, the cylinder 30 may be made from sheet material which is uniformly perforated with holes such as the holes 50, 52. The filling may be applied by dipping the sheet into a bath of molten filling material.

The holes 50, 51, 52 may be relatively small, e.g. of the order of 0.5 – 0.75 mm.

We claim:

1. Combustion equipment for a gas turbine engine, comprising a wall defining a flame tube and having a given melting temperature, means defining first holes in said wall for the entry of combustion and dilution air into the interior of the tube, means defining second holes in said wall, a filling contained in said second holes and being of a melting temperature less than that of the wall, whereby if in operation the temperature of the tube exceeds the melting temperature of the fillings the latter melt and cooling air can enter the tube through the second holes.

2. Combustion equipment according to claim 1 wherein said flame tube has a primary zone, said first holes are arranged in the primary zone of the flame tube for the entry thereinto of combustion air, and wherein said second holes are of substantially smaller size than the first holes and arranged therearound.

3. Combustion equipment according to claim 1 wherein said flame tube has a dilution zone, said first holes are arranged in the dilution zone for the entry thereinto of dilution air, and wherein said second holes are of substantially smaller size than the first holes and are arranged therearound.

4. Combustion equipment according to claim 1 wherein the flame tube comprises a first cylinder, a second cylinder having a portion overlapping a portion of the second cylinder, means defining openings extending between said overlapping portions from the exterior to the interior of the tube, and wherein said second holes are arranged adjacent said openings at the downstream side thereof.

5. Combustion equipment according to claim 1 wherein the filling is made of a material having a melting point of 800° – 900° C.

6. Combustion equipment according to claim 1 wherein the tube is made of heat-resisting nickel-based alloy and the filling material is selected from the group consisting of nickel and silver-based alloys.

7. Combustion equipment according to claim 1 wherein the second holes have a diameter of between 0.5 and 0.75 mm.

8. Combustion equipment according to claim 1 wherein the tube comprises joined sections at least one of which is made of sheet material perforated over at least a part of its area with said second holes.

* * * * *